US008678212B2

(12) United States Patent
Kim

(10) Patent No.: US 8,678,212 B2
(45) Date of Patent: Mar. 25, 2014

(54) CONTAINER AND CONTAINER COVER FOR SEALING THE CONTAINER OPENING

(75) Inventor: Sang-Kee Kim, Suseong-gu (KR)

(73) Assignee: Sunrise Kitchen Co., Ltd. (KR)

( * ) Notice: Subject to any disclaimer, the term of this patent is extended or adjusted under 35 U.S.C. 154(b) by 987 days.

(21) Appl. No.: 10/568,092

(22) PCT Filed: Aug. 27, 2004

(86) PCT No.: PCT/KR2004/002163

§ 371 (c)(1),
(2), (4) Date: Feb. 10, 2006

(87) PCT Pub. No.: WO2005/021396

PCT Pub. Date: Mar. 10, 2005

(65) Prior Publication Data

US 2007/0023434 A1 Feb. 1, 2007

(30) Foreign Application Priority Data

Aug. 27, 2003 (KR) ..... 20-2003-0027569 U

(51) Int. Cl.
*B65D 41/01* (2006.01)
*B65D 41/16* (2006.01)
*B65D 45/32* (2006.01)

(52) U.S. Cl.
USPC ..... 215/319; 215/274; 215/317; 215/320; 220/287; 220/319; 220/324

(58) Field of Classification Search
USPC ..... 215/274, 317, 319, 320, 321; 220/287, 220/315, 319, 320, 324
See application file for complete search history.

(56) References Cited

U.S. PATENT DOCUMENTS

| | | | | | |
|---|---|---|---|---|---|
| RE8,382 | E | * | 8/1878 | Harris | 215/321 |
| 1,546,159 | A | * | 7/1925 | Wippler, Sr. | 215/320 |
| 1,554,745 | A | * | 9/1925 | McMann | 215/321 |
| 1,857,853 | A | * | 5/1932 | McMann | 215/321 |
| 1,904,091 | A | * | 4/1933 | Shoop | 220/803 |
| 1,946,981 | A | * | 2/1934 | Lower | 215/320 |
| 2,064,411 | A | * | 12/1936 | Brandstein | 215/321 |
| 2,168,734 | A | * | 8/1939 | Freeman | 215/270 |
| 2,208,899 | A | * | 7/1940 | Freeman | 215/307 |
| 2,212,804 | A | * | 8/1940 | Wynings et al. | 215/200 |
| 2,215,392 | A | * | 9/1940 | Freeman | 215/320 |

(Continued)

FOREIGN PATENT DOCUMENTS

| | | | | | |
|---|---|---|---|---|---|
| JP | 54013634 | U | | 1/1979 | |
| JP | 54-034635 | U | * | 3/1979 | B65D 43/02 |

(Continued)

*Primary Examiner* — J. Gregory Pickett
*Assistant Examiner* — Ned A Walker
(74) *Attorney, Agent, or Firm* — Park & Associates IP Law, P.C.

(57) ABSTRACT

A receptacle sealing system includes a container with a rim defined at an upper opening thereof, and an adjustable closure for covering the opening of the container and having a sealed orientation and an unsealed orientation. The adjustable closure includes a rigid lid, and an integral annular seal having an outer annular wall, wherein when the adjustable closure is disposed in the unsealed orientation, the outer annular wall is oriented in the first position to face the top surface of the rigid lid, and, wherein when the adjustable closure is disposed in the sealed orientation, the outer annular wall is oriented in the second position in order to substantially seal onto the upper exterior wall of the container.

1 Claim, 6 Drawing Sheets

(56) References Cited

U.S. PATENT DOCUMENTS

| | | | | | |
|---|---|---|---|---|---|
| 2,266,270 | A | * | 12/1941 | Roth | 215/317 |
| 2,303,733 | A | * | 12/1942 | Freeman | 215/237 |
| 2,393,578 | A | * | 1/1946 | Waite | 215/248 |
| 2,487,400 | A | * | 11/1949 | Tupper | 220/802 |
| 2,585,602 | A | * | 2/1952 | Turner | 220/796 |
| 2,639,058 | A | * | 5/1953 | Lobl | 220/319 |
| 2,901,140 | A | * | 8/1959 | Robinson | 215/277 |
| 3,074,578 | A | * | 1/1963 | Hester | 215/321 |
| 3,241,663 | A | * | 3/1966 | Kaepernik | 206/63.3 |
| 3,317,069 | A | * | 5/1967 | Chin | 215/353 |
| 3,527,375 | A | * | 9/1970 | Klein | 220/806 |
| 3,628,542 | A | * | 12/1971 | Drew | 131/176 |
| 3,901,405 | A | * | 8/1975 | Norberg | 220/287 |
| 3,907,158 | A | * | 9/1975 | Frankenberg | 220/269 |
| 4,061,244 | A | * | 12/1977 | Tucker | 220/212 |
| 4,094,429 | A | * | 6/1978 | Urbin | 215/305 |
| 4,333,584 | A | * | 6/1982 | Gall | 220/309.1 |
| 4,376,493 | A | * | 3/1983 | Gall | 220/784 |
| 4,387,820 | A | * | 6/1983 | Ignell | 215/320 |
| 4,456,143 | A | * | 6/1984 | Davis et al. | 220/214 |
| 4,465,205 | A | * | 8/1984 | Sutch | 220/276 |
| 4,574,975 | A | * | 3/1986 | Taylor et al. | 220/780 |
| 4,632,271 | A | * | 12/1986 | Taylor et al. | 220/258.2 |
| 4,768,668 | A | * | 9/1988 | Van Den Brink | 215/305 |
| RE32,927 | E | * | 5/1989 | Taylor et al. | 220/780 |
| 5,103,990 | A | * | 4/1992 | Irwin | 215/320 |
| 5,348,181 | A | * | 9/1994 | Smith et al. | 220/254.3 |
| 5,522,518 | A | * | 6/1996 | Konrad et al. | 215/247 |
| 5,695,086 | A | | 12/1997 | Viola | |
| 6,415,947 | B1 | * | 7/2002 | Kim | 220/788 |
| 6,527,301 | B1 | * | 3/2003 | Bathey | 285/45 |
| 6,588,619 | B2 | * | 7/2003 | Cardarelli | 220/270 |
| 6,935,380 | B2 | * | 8/2005 | Rahimzadeh et al. | 138/96 R |
| 2003/0015542 | A1 | * | 1/2003 | Nulty et al. | 220/780 |
| 2005/0224499 | A1 | * | 10/2005 | Jorgensen et al. | 220/315 |
| 2006/0032852 | A1 | * | 2/2006 | Cai | 220/287 |
| 2006/0231563 | A1 | * | 10/2006 | Olivar | 220/780 |

FOREIGN PATENT DOCUMENTS

| | | |
|---|---|---|
| JP | 54034635 | 3/1979 |
| JP | 03049953 | 3/1991 |
| JP | 03126808 | 5/1991 |
| JP | 09221157 | 8/1997 |
| KR | 201983001653 | 10/1983 |

* cited by examiner

CONTAINER AND CONTAINER COVER FOR SEALING THE CONTAINER OPENING

TECHNICAL FIELD

The present invention relates to a container and its cover, and more particularly, to a container and its cover which can be applied to the container irrespective of the type or size of the container. In addition, the container cover of the present invention can be easily treated and can prevent the leakage of contents from the container.

BACKGROUND ART

In general, a container cover is sized to match an inlet of a container to which the container cover is applied. For example, in case that a food container has a circular inlet, a container cover is made of plastic and so fabricated that it can be fitted into the circular inlet.

Like this, it has been required to provide a structure having cover and container inlets fitted with each other in order to prevent the leakage of contents.

This means that the respective containers must use their own covers.

In practice, many containers are not provided with their own covers. Such containers generally adapt a different method for preventing the leakage of contents. For example, a wrap film made of vinyl is frequently used at a restaurant or household to seal a vowel or container containing contents such as hot soup so that the contents do not leak out of the container.

According to the above method, since the wrap film is disposable, unnecessary waste occurs. In addition, since the wrap film can be easily torn, it is used by an unnecessarily great quantity to prevent the possibility of tearing.

There are also problems in that the wrap film covering hot soup contained in the container can easily tear and more than anything else it is not easy to remove the wrap film from the container.

Further, since the wrap film is disposable, a great quantity of waste is produced, causing a serious environmental problem due to the material property of the wrap film.

DISCLOSURE OF THE INVENTION

Technical Problem

It is an object of the present invention to provide a container, and a container cover which can be applied to the container irrespective of the type or size of the container.

It is another object of the present invention to provide a container cover which can be easily used, and does not cause resource waste or an environmental problem.

The foregoing and other features and advantages of the present invention will be set forth in preferred embodiments which will be described hereinafter.

Technical Solution

According to an aspect of the present invention for realizing the above objects, there is provided a container cover comprising: a cover plate having a rear surface for contacting a container; and an annular closing member having a peripheral portion fixed to the cover plate along a rear peripheral portion of the cover plate and a remaining portion for detachably and resiliently contacting the rear surface of the cover plate.

Preferably, the peripheral portion of the closing member is extended to a side end or a surface periphery of the cover plate and fixed thereto.

According to another aspect of the present invention for realizing the above objects, there is provided a container cover comprising: a cover plate having a rear surface for contacting a container; and a closing member having a fixing portion fixed to the cover plate along a peripheral portion of a surface of the cover plate and an annular contact portion bent from the fixing portion toward the surface and extending integrally therefrom.

According to further another aspect of the present invention for realizing the above objects, there is provided a container cover comprising: a cover plate contacting a container at its back surface; and a closing member having at least a pair of fixing portions fitted on the cover plate along a peripheral portion of a surface of the cover plate and an annular contact portion bent from the fixing portion toward the surface and extending integrally therefrom.

Preferably, the cover plate has a round formed at a side end of the cover plate along its lower peripheral portion, and a ball-shaped press protrusion formed at the contact portion along its end contacting the container.

Preferably, the closing member is made of silicone, or one selected from the group consisting of polycarbonate, polyethylene, polyvinyl chloride (PVC) and acryl.

According to the present invention, there is an advantage in that the container cover can be applied to a container irrespective of the type or size of the container.

Also, there is an advantage in that the container cover is easily used since it can be simply wrapped on the container and removed therefrom.

Furthermore, there is an advantage in that since the container cover is not disposable like wrap film or vinyl, and therefore does not cause resource waste or resultant environmental problem.

Advantageous Effects

According to the container cover as described hereinbefore, the container cover can be applied to and used with a container irrespective of the type or size of the container. Since the container cover is not disposable unlike wrap film, it does not bring resource waste or resultant environmental problem.

The container cover of the present invention can be properly used also for storing contents such as food in a refrigerator. In particular, the container cover can seal the container so that the smell of the contents does not leak out of the container to spread in the refrigerator. In addition, containers having such container covers can be piled up with one above another to efficiently use the space of the refrigerator.

There is another advantage in that the container can be heated to cook or warm the contents in the container with a microwave oven.

While the present invention has been described and illustrated herein with reference to the preferred embodiments thereof, it will be apparent to those skilled in the art that various modifications and variations can be made therein without departing from the spirit and scope of the invention.

For example, in order to prevent decoloration of the closing member, made of silicone, by food, the closing member can be coated. Also, the cover plate is not limited to a circular configuration, but can be fabricated into various configurations such as rectangle or triangle in accordance with that of inlet of the container.

Therefore, it is intended that the present invention is not limited by the foregoing embodiments but shall be defined by the accompanying claims.

BEST MODE FOR CARRYING OUT THE INVENTION

Hereinafter, preferred embodiments of the present invention will be described in detail with reference to accompanying drawings.

Figure 1:
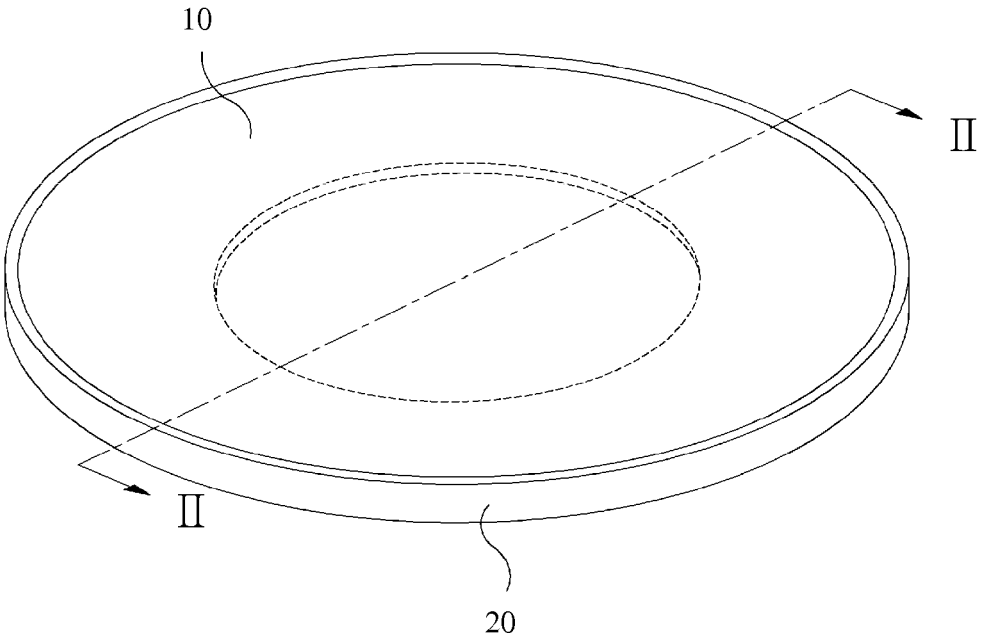
FIG. 1 is a perspective view of a container cover according to a first embodiment of the present invention.
Figure 2:
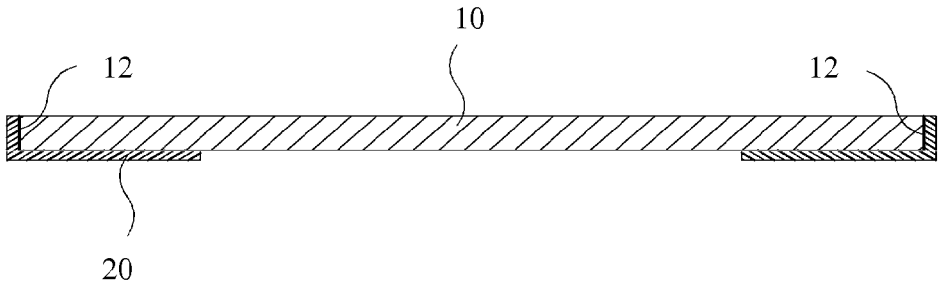
FIG. 2 is a cross-sectional view taken along a line II-II of FIG. 1.
Figure 3:
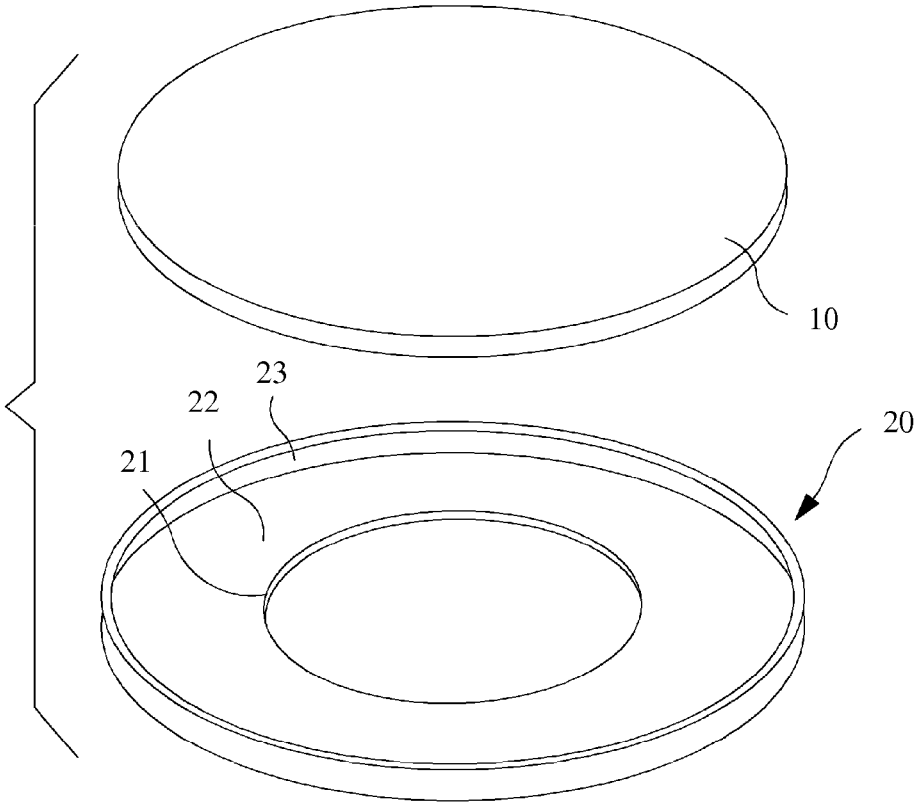
FIG. 3 is an exploded perspective view of FIG. 1.

FIG. 1 is a perspective view of a container cover according to a first embodiment of the present invention, FIG. 2 is a cross-sectional view taken along a line II-II of FIG. 1, and FIG. 3 is an exploded perspective view of FIG. 1.

As shown in the drawings, a cover plate 10 has a certain thickness, and is formed transparent so that contents contained in a container can be seen from the outside. In addition, the cover plate 10 can provide an aesthetic appearance.

The cover plate can be composed of any toxic-free material selected from a group including polycarbonate, polyethylene, polyvinyl chloride (PVC), acryl and so on, which has excellent shock strength, high heat resistance and low temperature property. The cover plate can be composed of any material selected properly according to use so that it can be stored in a refrigerator or heated in a microwave range.

Referring to FIG. 3, a closing member 20 has an annular contact portion 22 and a fixing portion 23 integrally formed vertically along a peripheral portion of the contact portion 22. Because of the annular configuration, the contact portion 22 has a through opening 21 formed at a central portion thereof.

The fixing portion 23 is fixed to the cover plate 10 along a side end thereof, and the contact portion 22 detachably and resiliently contacts a back surface of the cover plate 10.

The closing member 20 is made of flexible and resilient material, such as silicone and so on.

Unexplained reference numeral 12 indicates an adhesive provided between the cover plate 10 and the closing member 20.

Figure 4:
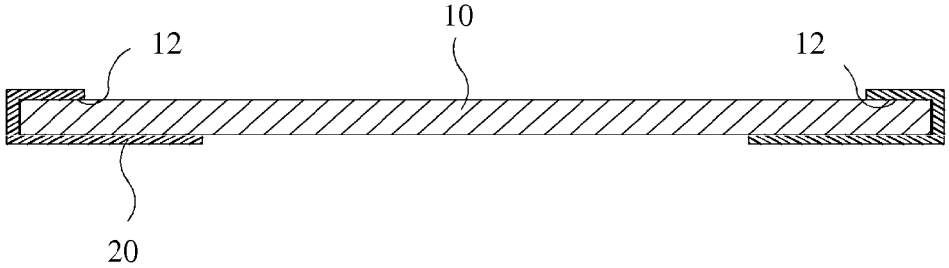
FIG. 4(*a*) and 4(*b*) are, respectively, a cross-sectional view of modifications to the first embodiment of the present invention.
Figure 4:
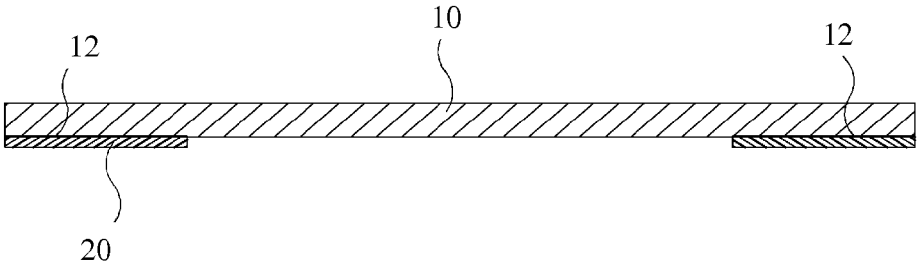

As shown in FIG. 4(*a*), the fixing portion can be U-shaped so that it can be attached to the side end and the upper surface of the cover plate 10. Alternatively, as shown in FIG. 4(*b*), instead of having a separate fixing portion in the closing member 20, a part of a circumference of the contact portion can be fixed along the peripheral portion of the back surface of the cover plate 10.

A method for practically adapting the container cover having the above construction to a container will be now explained with reference to FIG. 5.

Figure 5:
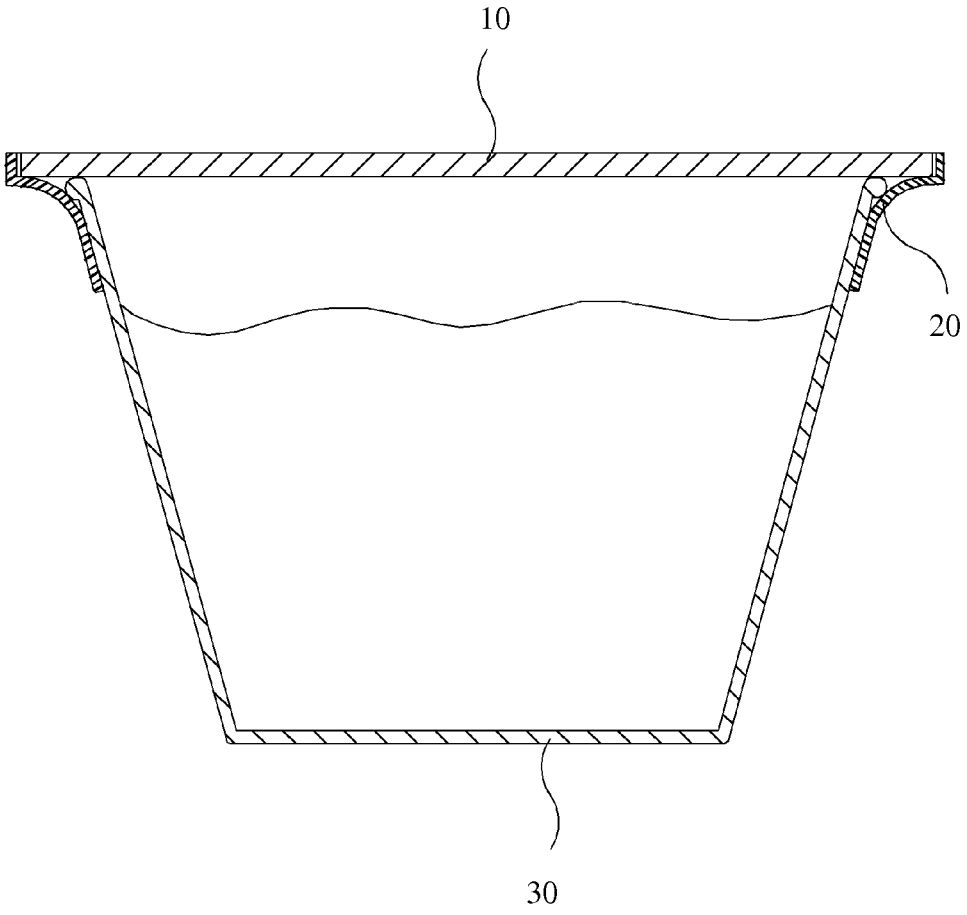
FIG. 5 is a cross-sectional view in which the container cover according to the first embodiment of the present invention is applied to a container.

FIG. 5 illustrates an embodiment of a container cover that is sized larger than a container.

Palms of both hands are placed on the peripheral portion of the cover plate 10, and four fingers except for thumbs are inserted between the contact portion 22 of the closing member 20 and the back surface of the cover plate 10 to erect the contact portion 22 of the closing member 20 from the cover plate as shown in the drawing.

Next, the cover plate 10 is placed on an inlet of the container 30 so that the erected contact portion 20 is opposed to a side surface of the container 30, and then the four fingers are retracted from the contact portion 22.

Herein, as described above, since the contact portion 22 of the closing member 20 has flexibility and resilience, it tightly clamps or clings to the side surface of the container due to its elastic force so that the container cannot slide out of the contact portion 22. At this time, when a width of the contact portion 22 is enlarged, clamping force can be magnified correspondingly.

The container can be stored or moved in this state so that contents contained therein do not leak to the outside. Also, when the container cover is removed from the container, above processes are conducted reversely.

Figure 6:
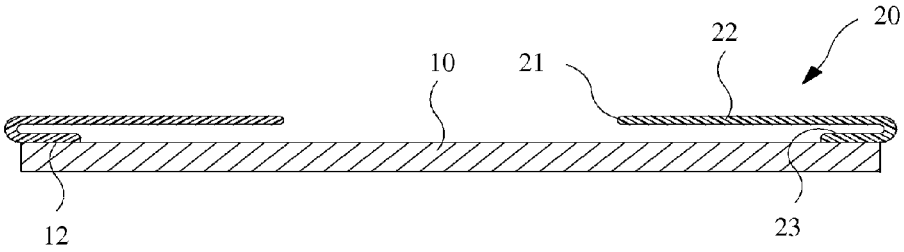
FIG. 6 is a cross-sectional view of a container cover according to a second embodiment of the present invention.
Figure 7:
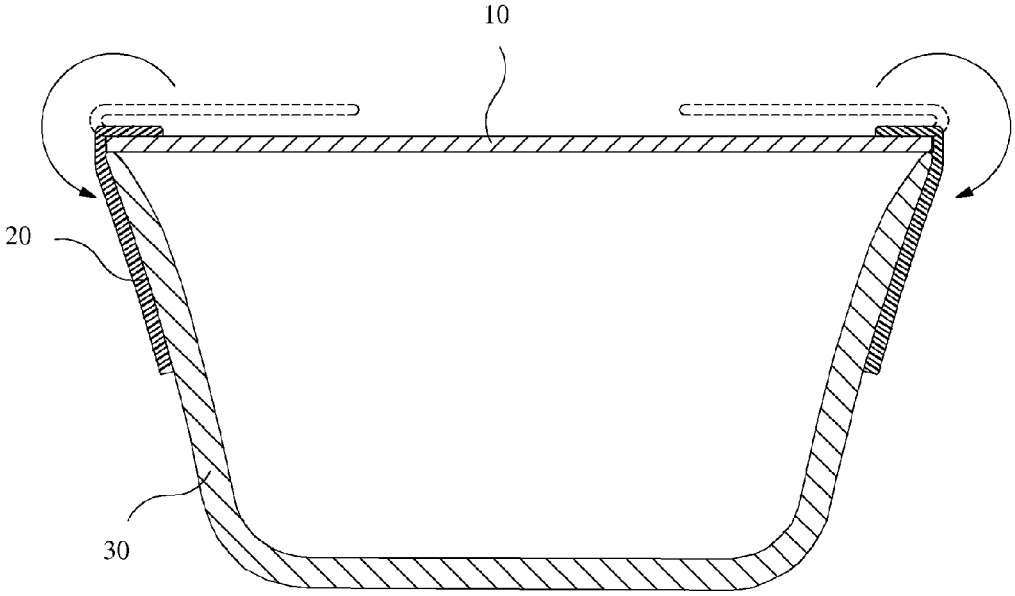
FIG. 7 is a cross-sectional view in which the container cover according to the second embodiment of the present invention is applied to a container.

FIG. 6 is a cross-sectional view of a container cover according to a second embodiment of the present invention, and FIG. 7 is a cross-sectional view in which the container cover according to the second embodiment of the present invention is applied to a container.

The cover plate 10 is fabricated with polycarbonate, polyethylene, polyvinyl chloride (PVC), or acryl and so on. The cover plate is preferably formed transparent so that contents contained in the container can be seen from the outside.

The cover plate 10 may have a round 11 (see FIG. 8) at its lower portion of the side end thereof so that the round 11 can contact an upper end portion of the container 30, which will be described as follows.

Referring to FIG. 6, the closing member 20 of this embodiment has a fixing portion 23 fixed to the upper surface of the cover plate 10 with an adhesive 12 interposed therebetween, and a contact portion 22. The contact portion 22 is integrally formed along the peripheral portion of the fixing portion 23 and bent and extends toward the upper surface of the cover plate 10. Having an annular configuration, the closing member has a through opening 21 at a central portion of the contact portion 22.

The contact portion 22 and the fixing portion 23 can be integrally injection-molded from for example toxic-free silicone.

Hereinafter, a method for using the container cover of this embodiment will be explained with reference to FIG. 7.

The container cover is placed on an upper end portion of the container 30 in which contents are contained, and the contact portion 22 positioned on the upper surface of the cover plate 10 is turned inside out by 270 degrees with fingers as indicated with arrows to contact an outer surface of the container 30.

The contact portion 22 is bent from the fixing portion 23 to tightly contact the outer surface of the container 30 so that the cover plate can strongly clamp the container 30.

This embodiment has advantages in that the adhesive 12 is applied to the surface of the cover plate 10 so that it does not directly affect contents in the container 30, and in that the contact portion 22 is turned or flipped inside out from the upper surface of the cover plate 10 to facilitate handling.

Figure 8:
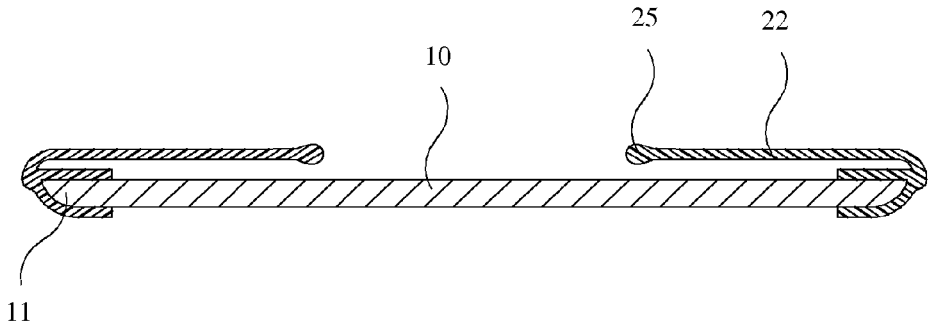
FIG. 8 is a cross-sectional view of a container cover according to a third embodiment of the present invention.
Figure 9:
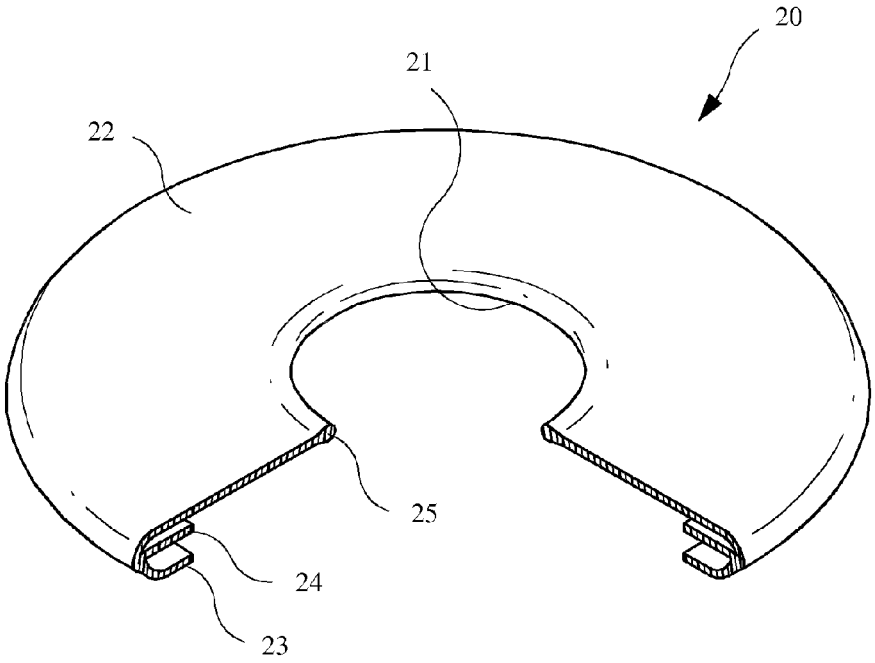
FIG. 9 is a perspective view of a container cover of FIG. 8 which is partially broken.
Figure 10:
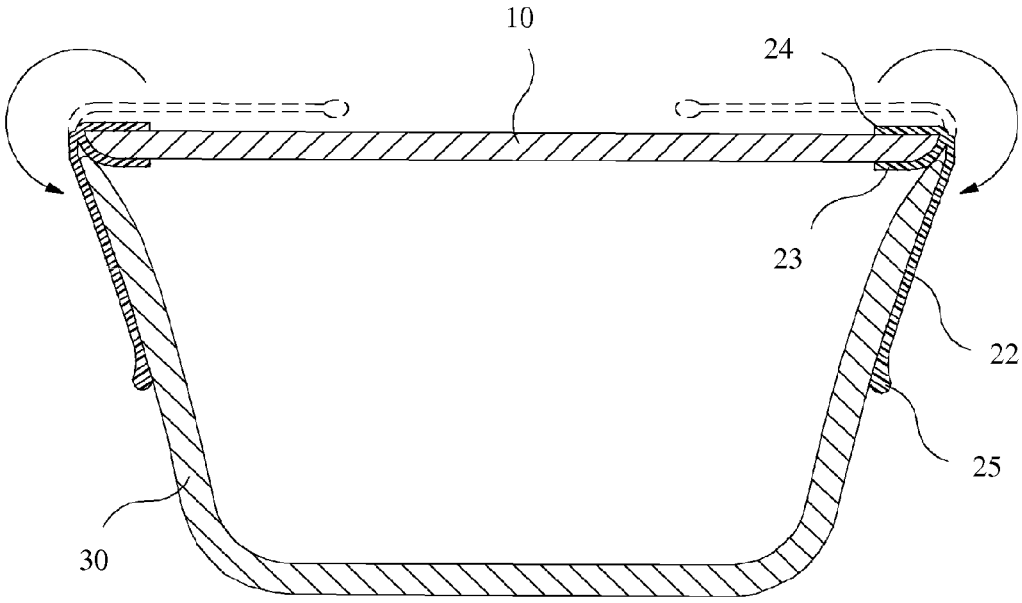
FIG. 10 is a cross-sectional view in which the container cover of FIG. 8 is applied to a container.

FIG. 8 is a cross-sectional view of a container cover according to a third embodiment of the present invention, FIG. 9 is a perspective view of a container cover of FIG. 8 which is partially broken, and FIG. 10 is a cross-sectional view in which the container cover of FIG. 8 is applied to a container.

The cover plate 10 is made of polycarbonate, polyethylene, polyvinyl chloride (PVC), or acryl and so on. The cover plate is preferably formed transparently so that contents contained in the container can be seen from the outside.

Referring to FIG. 9, the closing member 20 of this embodiment has a pair of fixing portions 23 and 24 fitted on a peripheral portion of the cover plate 10, and a contact portion 22. The contact portion 22 is integrally formed along the peripheral portion of the fixing portions 23 and 24 and extends toward the upper surface of the cover plate 10. A press protrusion 25 is formed at an end of the contact portion 22 along a circumference of a through opening 21 so as to press the outer surface of the container. The contact portion 22 and the fixing portions 23 and 24 can be integrally injection-molded from for example toxic-free silicone to have an E-shaped cross-sectional configuration.

Hereinafter, a method for using the container cover of this embodiment will be explained with reference to FIG. 10.

The peripheral portion of the cover plate 10 is inserted into a space defined by the fixing portions 23 and 24 to couple the closing member 20 and the cover plate 10 with each other. Herein, if the closing member 20 is selected slightly smaller than that of the cover plate 10, stronger coupling can be obtained more reliably.

After the closing member 20 and the cover plate 10 are coupled with each other, the container cover is positioned on an upper end portion of the container 30, in which contents are contained, and the contact portion 22 positioned on the upper surface of the cover plate 10 is turned inside out 270 degrees with fingers as indicated with arrows to contact an outer surface of the container 30.

Herein, the cover plate 10 has a round 11 at its lower portion of the side end thereof to contact a rounded upper end portion of the container 30 with the resilient fixing portion 23 interposed therebetween, thus primarily forming a sealed state.

The contact portion 22 is resiliently bent from the fixing portion 23 to tightly contact the outer surface of the container 30 so that the cover plate and the container 30 are securely coupled with each other.

Preferably, a circular-shaped press protrusion 25 is formed at an end of the contact portion 22 so as to securely press the outer surface of the container 30.

According to this embodiment, there are advantages in that the adhesive (12) is not used unlike other embodiments, and in that a contact portion is turned inside out from above the container cover to enable an easy covering/uncovering operation.

The invention claimed is:

1. A receptacle and closure sealing system comprising:
- a container comprising:
  - an exterior wall; and,
  - a rim defining an upper opening;
- an adjustable closure having a sealed orientation and an unsealed orientation, said closure comprising:
  - a rigid lid comprising:
    - a top surface;
    - a bottom surface; and,
    - a flared outer edge;
  - an integral annular seal comprising:
    - an inwardly facing channel surrounding said rigid lid, allowing said rigid lid and said annular seal to be cooperatively seated upon said rim of said container, said inwardly facing channel having:
      - an upper portion secured to said top surface,
      - a lower portion secured to said bottom surface, and
      - a joint connecting said upper portion to said lower portion;
    - an outer annular wall having:
      - a first planar surface,
      - a second planar surface opposite from said first planar surface,
      - a distal end formed by a beaded flange, and
      - a proximal end formed by a flexible junction with said joint of said channel, said flexible junction allowing said outer annular wall to pivot between an upper and substantially horizontal first position to a lower and substantially vertical second position;
- wherein when said adjustable closure is disposed in said unsealed orientation, said outer annular wall is oriented in said first position with said first planar surface facing said top surface of said rigid lid; and,
- wherein when said adjustable closure is disposed in said sealed orientation, said outer annular wall is oriented in said second position with said second planar surface substantially sealed to an upper portion of said exterior wall of said container.

* * * * *